United States Patent [19]

Krotsch

[11] Patent Number: 4,736,566

[45] Date of Patent: Apr. 12, 1988

[54] MODULAR FABRICATION PANEL SYSTEM

[76] Inventor: Harold V. Krotsch, P.O. Box 282, Rancho Santa Fe, Calif. 92067

[21] Appl. No.: 571,667

[22] Filed: Jan. 17, 1984

[51] Int. Cl.[4] ..... E04C 2/32

[52] U.S. Cl. ..... 52/795; 52/674; 52/814

[58] Field of Search ..... 52/795, 537, 630, 671, 52/674, 814, 635, 670, 802, 220, 800, 799, 631

[56] References Cited

U.S. PATENT DOCUMENTS

| | | | |
|---|---|---|---|
| 2,934,934 | 5/1960 | Berliner | 52/674 X |
| 3,108,406 | 10/1963 | Ellis | 52/670 X |
| 3,143,827 | 8/1964 | Showalter, Sr. | 52/814 X |
| 3,290,845 | 12/1966 | Snyder | 52/795 X |
| 4,065,896 | 1/1978 | Penczak | 52/220 |

FOREIGN PATENT DOCUMENTS

| | | | |
|---|---|---|---|
| 2521539 | 12/1975 | Fed. Rep. of Germany | 52/631 |
| 260801 | 12/1946 | Switzerland | 52/631 |
| 275709 | 6/1951 | Switzerland | 52/795 |
| 439659 | 12/1967 | Switzerland | 52/814 |

*Primary Examiner*—William F. Pate, III
*Assistant Examiner*—Naoho N. Slack
*Attorney, Agent, or Firm*—Albert L. Gabriel

[57] ABSTRACT

The present invention discloses a modular fabrication panel unit comprising a horizontally-disposed corrugated gypsum board core, the corrugation forming a series of truncated crests and troughs, framed and braced by substantially U-shaped channel supports formed of structural steel, corrugated core and supports then being sandwiched between panel skin comprising either plywood or gypsum board, depending on whether the panel is to be used as a section of an interior wall, exterior wall or roof. The panel skin is attached to the flat outwardly-facing surfaces of the core formed by its truncated corrugation. The modular fabrication panel unit of the present invention may be manufactured utilizing inexpensive machinery and nonspecialized manual labor, either on-site or in a factory situation. The modular fabrication panel unit is a low-cost, low-maintenance, fire-retardant, structurally sound modular construction member having good insulating and acoustical properties.

14 Claims, 3 Drawing Sheets

MODULAR FABRICATION PANEL SYSTEM

BACKGROUND OF THE INVENTION

1. Field of the Invention

The present invention relates to prefabricated modular structural members and especially those to be used within low-cost construction.

2. Description of the Prior Art

The prefabrication of structural members to be incorporated within a modular structure has in recent history begun to enable adequate low-cost construction providing, for example, low-cost housing development. As the art of prefabrication matures, the problems to be addressed include the enhancement of the structural properties of the independent modular members and of the assembled structure as a whole while keeping production and labor costs at a minimum.

The early development of prefabricated structural members provided for little or no structural support, as in U.S. Pat. No. 3,717,672 wherein a non-load-bearing drywall partition is disclosed. The drywall partition of the disclosure is intended for rapid assembly and removal of a temporary internal partition and addresses no further structural problems.

U.S. Pat. Nos. 3,246,058 and 3,555,756 concern themselves with foamed plastic-filled insulating panels and the methods for producing them. These patents do not disclose panels or structural members which in combination are capable of providing the structural framework required for a modular structure. U.S. Pat. No. 3,246,058 makes no reference to the incorporation of the disclosed foam sandwich structures within a modular construction. The panel unit disclosed in U.S. Pat. No. 3,555,756 depends upon a preassembled building structural framework in order to be incorporated within a structure.

The production of the panels disclosed in these patents relies heavily upon expensive machinery, semi- or fully-automated, and upon the high-cost labor required to operate such machinery. In addition, the panels produced provide no accommodation for the passage of utility lines such as piping or electrical conduit throughout the walls of a modular structure.

The structural member of U.S. Pat. No. 4,052,828 discloses a sandwich panel comprising outer drywall boards sandwiching a vertically-disposed accordion-pleated cardboard core. While the insulating and acoustical properties of the disclosed structural member are more or less adequate, the configuration of the device provides a structural fire hazard in that it allows and indeed encourages chimney updraft within the core of the structural member owing to the vertical disposition of the accordion-pleated core. The cardboard core even though treated for water and fire resistance is still, especially over a period of time within a modular structure, susceptible to waterlogging or combustion. Adequate water or fireproofing undermines whatever cost advantage is gained by the utilization of a cardboard core. Alternate embodiments disclosed of the structural member in U.S. Pat. No. 4,052,828 replace the pleated core with plastic or metal material raising the cost of the structural member. Although the plastic pleating would be less expensive than the sheet metal pleating, the consequences in terms of both structural collapse and occupant safety of the plastic melting during a fire are far from desirable. Only the vertical pleated sheet metal embodiment disclosed would provide any real vertical beam support and the excessive utilization of expensive sheet metal material renders that embodiment of the structural member economically untenable for use in a low-cost construction situation. The vertical disposition of the pleated core does not facilitate the required horizontal passage of utility lines throughout the interior of the walls of a modular structure. Finally, the accordion pleating of the core allows for very limited contact area for attachment to the outer paneling.

Applicant is aware of no adequate low-cost, low-maintenance, fire-resistant modular structural members having good insulating and acoustical properties which also allow and accommodate the passage of utility lines throughout the walls of a modular structure which do not require expensive machinery for manufacture and which may be assembled either on-site or in an off-site factory situation.

SUMMARY OF THE INVENTION

In view of these and other problems in the prior art, it is a general object of the present invention to provide a low-cost modular fabrication panel which has a corrugated core and which is a sound structural member for incorporation within a modular structure.

Another object of the present invention is to provide a modular fabrication panel as described above wherein the corrugation of the panel core is horizontally disposed.

Another object of the present invention is to provide a modular fabrication panel as described above wherein the corrugation of the panel core takes the shape of a series of truncated crests and troughs, providing extensive contact area for attachment to an exterior panel skin.

Another object of the present invention is to provide a modular fabrication panel as described above which is structurally and materially fire resistant.

Another object of the present invention is to provide a modular fabrication panel as described above which has good insulating and acoustical properties.

Yet another object of the present invention is to provide a modular fabrication panel as described above which comprises low-cost materials.

Another object of the present invention is to provide a modular fabrication panel as described above which may assembled or manufactured utilizing inexpensive manufacturing means.

Still another object of the present invention is to provide a modular fabrication panel as described above wherein the fabrication of the panel does not require expensive specialized labor.

Yet another object of the present invention is to provide a modular fabrication panel as described above which may be utilized as a portion of either an exterior wall, interior wall or roof panel.

A further object of the present invention is to provide a modular fabrication panel as described above which defines within its core horizontal passages for the accommodation of utility lines.

A still further object of the present invention is to provide a modular fabrication panel as described above having substantial vertical beam strength.

Yet another object of the present invention is to provide a modular fabrication panel as described above wherein the combination of a number of such panels in itself provides the structural framework required to support a modular structure.

Another object of the present invention is to provide a modular fabrication panel as described above which is essentially prefinished once assembled.

The modular fabrication panel of the present invention provides for the manufacture and assembly of a low-cost structural member to be used as a portion of either an exterior wall, an interior wall, or a roof. The core of the modular panel comprises a horizontally-disposed corrugated gypsum board bound and framed by substantially U-shaped channel supports formed of structural steel. The corrugation of the core is truncated so as to provide extensive outwardly-facing contact area for attachment to an exterior skin. Panel skin comprising plywood or gypsum board, depending on whether the panel is to be utilized as a section of either an interior wall, exterior wall or roof, is applied to both sides of the corrugated core and channel supports.

The channel supports framing the sides of the modular panel have utility ports which in combination with the horizontal-corrugation of the core accommodate the passage of utility lines throughout either an interior wall, exterior wall or roof. The corrugation of the wall and trapped air provide good insulating properties for the wall, while the corrugated gypsum board also baffles sound sufficiently to provide good acoustical qualities. The corrugation of the core and its attachment to the exterior skin of the panel lock up air within the wall so as to prevent the spread of fire. The horizontal disposition of the corrugation prevents updraft and hence the chimney effect which frequently encourages the spread of fire throughout a building.

The modular panel of the present invention may be manufactured and assembled utilizing only a table saw with multiple scoring blades and a fixed forming platform. Utilizing these two tools, unscored gypsum board is scored by the table saw on opposing sides and then pressed into the forming platform so as to form the corrugated gypsum board core of the modular panel. The gypsum board thus formed is fixed in its corrugated configuration by channel supports on the top, bottom and sides of the corrugated core. One side of the panel skin is applied to this conjunction of corrugated gypsum board and channel supports and the modular panel is ready to be fixed into position within the modular structure. The facing panel skin is applied after the insertion of utility lines.

In assembling the modular structure, the modular panels of the present invention are abutted side by side and welded together such that the substantially U-shaped channel supports framing the corrugated core are placed back to back and form an I-beam configuration. Thus, the roof of the modular structure is supported by vertical I-beams. Modular panels as defined by the present invention to be utilized as roofing sections are also abutted and welded together and then braced by I-beam rafters which are welded to the top of the I-beam conjunction of the vertical channel supports. The modular panels to be used as interior or exterior walls may be anchored directly to a poured concrete foundation.

Due to the simplicity of the assembly and manufacturing process, windows and doors may be prefabricated into the modular panels by either cutting a port of the desired size into a preassembled modular panel or by assembling a special door panel comprising smaller corrugating framing components. Once the basic wall structure has been completed utilizing the combination of modular panels as defined by the present invention, interior facing skin may be applied to the core of the modular panel covering the utility lines and corrugated core. The interior facing skin comprises gypsum board covered with wallpaper-like vinyl cloth having extended batten edges which may be overlapped.

DETAILED DESCRIPTION

Figure 1:
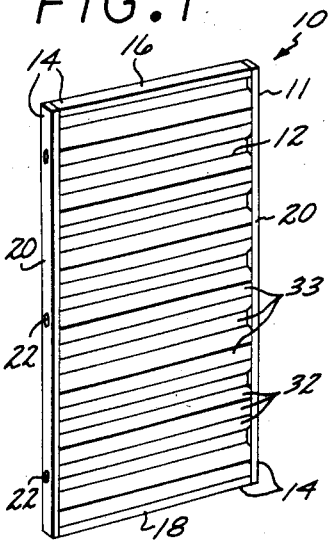
FIG. 1 is a perspective view of the modular panel of the present invention before being incorporated into a modular structure.
Figure 2:
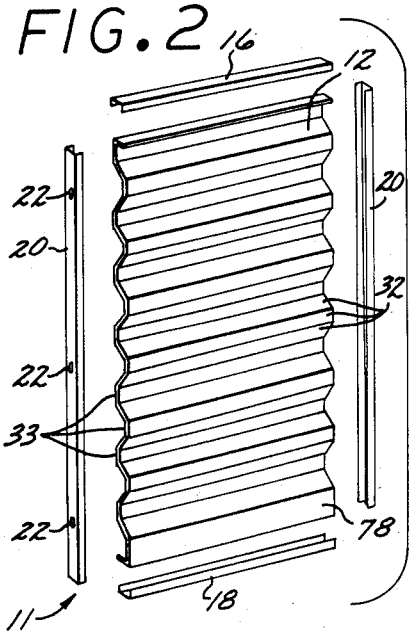
FIG. 2 is an expanded view in perspective of the panel core of the panel of the present invention.

Referring to the drawings and at first particularly FIGS. 1 and 2, the modular fabrication panel unit of the present invention is generally designated 10. It is intended for low cost modular construction and provides a low maintenance, fire-resistant, structurally-sound modular component having good insulation and acoustical properties. FIG. 2 shows the panel core 11 of the panel unit 10 which is composed of a horizontally-disposed corrugated gypsum board 12 bound and framed by channel supports 14. The channel supports 14 are substantially U-shaped members and preferably formed of a lightweight structural steel. The channel supports 14 are cut to form a top support 16, a bottom support 18 and side supports 20 for the corrugated gypsum board 12 of the panel core 11. In the side supports 20 are formed utility ports 22 through which piping, electrical conduits or other utility lines may pass when the panel unit 10 is incorporated in a modular structure.

Vertical dimensions such as top, bottom, upper and lower refer to the orientation of the panel unit 10 when it is incorporated as an exterior wall or interior partition in a modular structure. Centrical dimensions such as interior and exterior refer to the opposed skin of the panel unit 10 when incorporated as an exterior wall in a modular construction. These and all other dimensional terms are used in order to facilitate and clarify the present description and are not meant by way of limitation.

Figure 3:
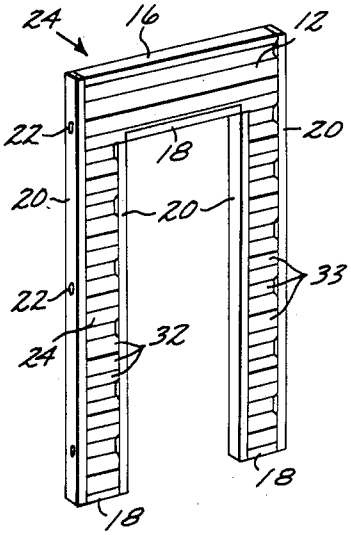
FIG. 3 is a perspective view of the modular panel of the present invention having a door prefabricated into it.

FIG. 3 illustrates a modular door frame 24 as prefabricated into a panel unit 10 where the horizontally-disposed gypsum board 12 defines the door frame 24. Notice that the jamb of the door frame 24 is also bound by channel supports 14. A modular door frame 24 may be formed utilizing either a substantially unitary prefabricated door frame 26 or an assembly of corrugated framing components which are essentially panels 10 of varied dimension. The substantially unitary prefabricated door frame 26 will generally be formed by assembling a solid panel unit 10 exclusive of the bottom support 18 and then cutting an opening of the desired size in the panel unit 10.

Figure 4:
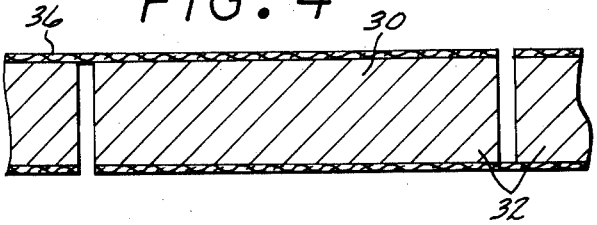
FIG. 4 is a fragmentary cross-sectional view of the scored gypsum board used in forming the corrugated core of the panel of the present invention.
Figure 5:
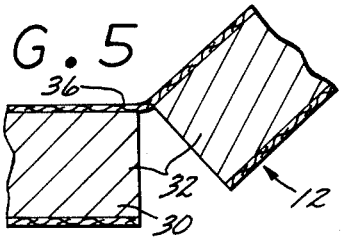
FIG. 5 is a fragmentary view in cross-section illustrating the flexibility of the covering of the gypsum board in forming the corrugated core of the modular panel of the present invention.

The corrugated gypsum board 12 utilized in the assembly of the panel core 11 of the panel unit 10 is formed from a scored gypsum board 30, comprising horizontally-disposed gypsum board sections 32 defined by alternately opposed double scoring cuts 34. In other words, the scored gypsum board 30, as indicated in FIGS. 4 and 5, has pairs of horizontally-disposed scoring cuts 34 borne alternately in the opposing faces of the board 30 throughout its length. The conventional gypsum board 30 has covering each of its opposing faces a flexible web 36 of paper or other relatively thin material. The scoring cuts 34 pass all the way through the scored gypsum board 30 to this web 36. The flexibility of this webbing 36 allows the scored gypsum board 30 to be flexed, as indicated in FIG. 5, in order to form the corrugated gypsum board 12 indicated in FIGS. 1–3.

Figure 8:
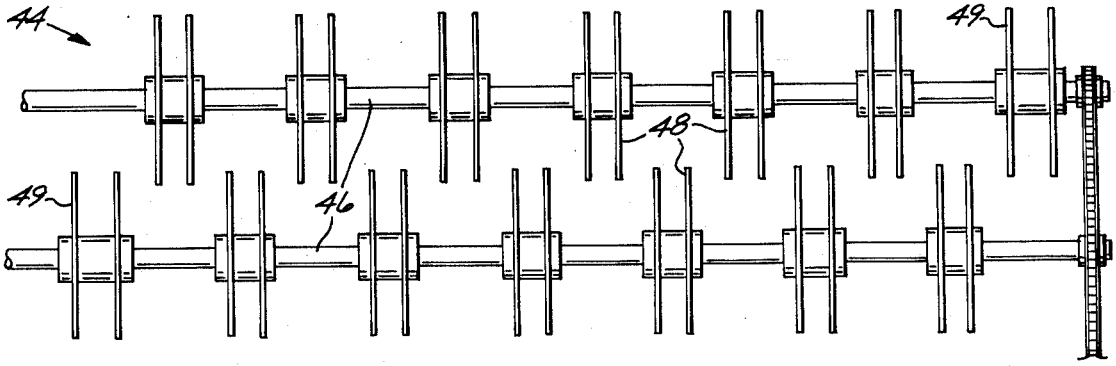
FIG. 8 is a fragmentary view in elevation taken on line 8—8 in FIG. 6.
Figure 6:
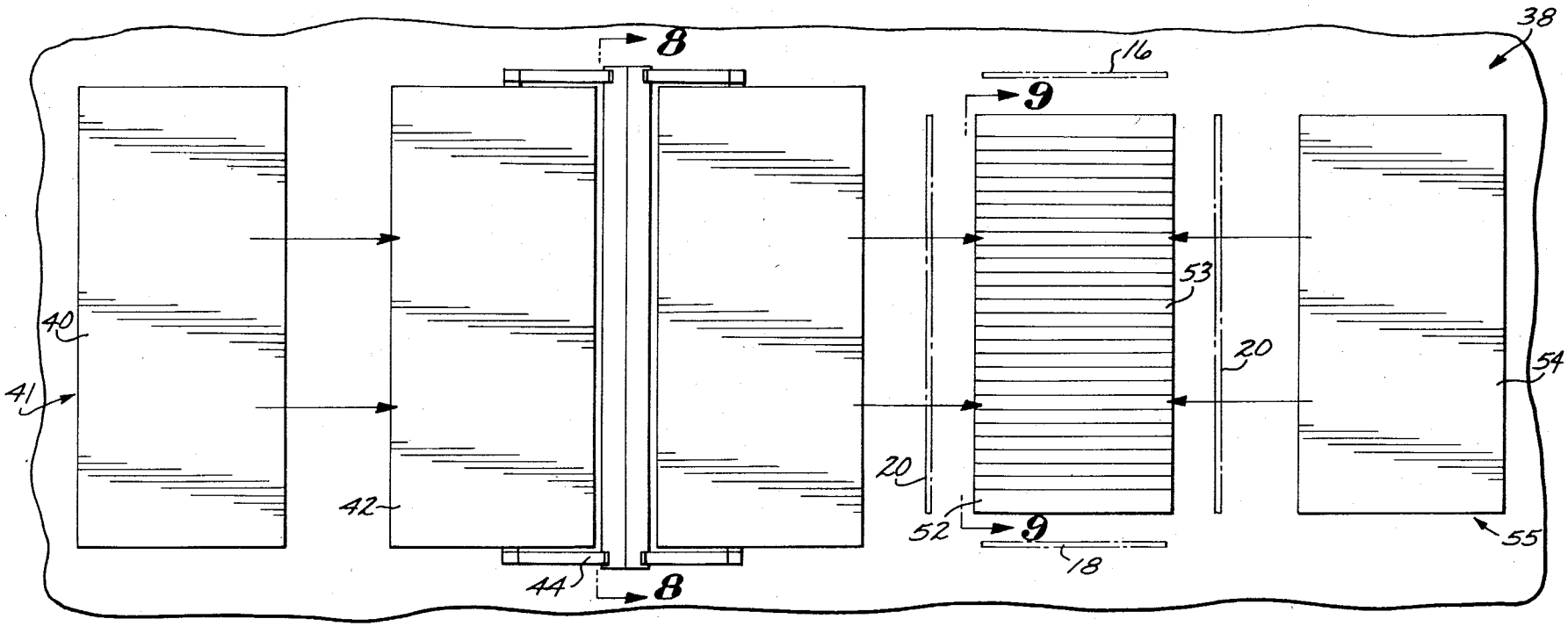
FIG. 6 is a top plan view in elevation of the assembly line utilized in manufacturing the modular panel of the present invention.
Figure 7:
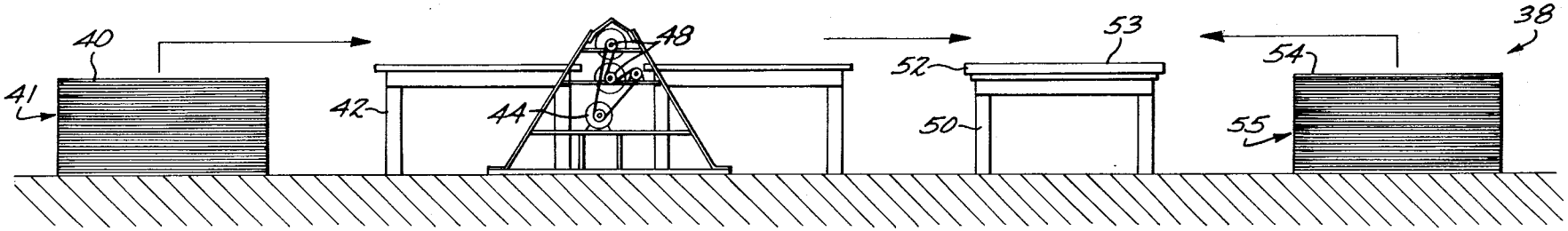
FIG. 7 is side view in elevation of the assembly line utilized in manufacturing the modular panel of the present invention.

FIGS. 6 and 7 indicate the formation of unscored gypsum board 40 into corrugated gypsum board 12 to be subsequently incorporated into a panel unit 10, also indicating the modular panel fabrication and assembly line 38 thereto pertaining. As indicated in FIGS. 6 and 7, single unscored gypsum boards 40 from a stack 41 are cut on a saw table 42 having a preferably rotary scoring saw 44 proximate its center. On this table the unscored gypsum board 40 is cut so as to form the scored gypsum board 30, as described above. The alternately opposed rotary double scoring blades 48 of the rotary scoring saw 44 are illustrated in FIG. 8. The scoring blades 48 are distributed substantially equidistantly along driving rods 46 between which passes the unscored gypsum board 40 as it is cut. Notice that the end double scoring rotary blades 49 located at opposing ends of the opposing driving rods 46 are wider than the rest of scoring blades 48, slightly altering the configuration of the ends of the corrugated gypsum board 12 for reasons to be described later in this description.

Figure 9:
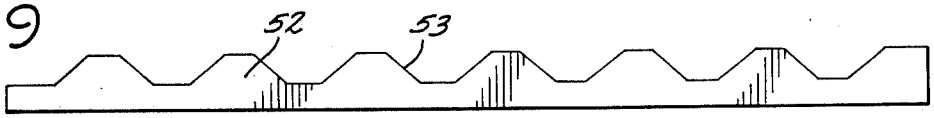
FIG. 9 is a view in elevation taken on line 9—9 in FIG. 6.
Figure 10:
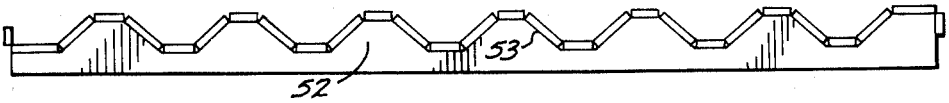
FIG. 10 is a side view in elevation of the formation of the corrugated core of the modular panel of the present invention formed from scored gypsum board utilizing a forming platform.

Once the unscored gypsum board 40 has been cut into scored gypsum board 30 on the saw table 42, the scored gypsum board 30 is placed on a forming and assembly table 50. The forming platform 52 defines the top of the forming and assembly table 50 and has an upper pattern surface 53, as indicated in FIG. 9, into which the scored gypsum board 30 may be pressed. Once the scored gypsum board 30 has been pressed into the pattern surface 53 of the forming platform 52, the scored gypsum board 30 bends along the web 36 into a truncated corrugated configuration. The scored gypsum board 30 thus becomes the corrugated gypsum board 12 of the panel core 11, as indicated in FIG. 10.

The framing platform 52 is slightly shorter and slightly narrower than the original unscored gypsum board 40. As the scored gypsum board 40 is pressed into the patterning surface 53 of the forming platform 52, preferably approximately one-ninth of the longitudinal extent of the scored gypsum board 40 is lost in order to form the transverse component of the corrugated gypsum board 12. Since the forming table 52 is slightly narrower than the scored gypsum board 40, the edges of the corrugated gypsum board 12 protrude over the sides of the forming platform 52, allowing the corrugated gypsum board 12 to be fixed in its truncated corrugated configuration by channel supports 14 cut into side supports 20 while the corrugated board 12 is still on the forming platform. The side supports 20 grip the corrugated board 12 efficiently because of the facing sections 33 formed by the truncated corrugation. Once the corrugated gypsum board 12 has been braced by the side supports 20, a top support 16 and a bottom support 18 may be attached to the ends of the corrugated board 12 fixing the corrugated board 12 into a panel core 11. The channel supports 14 may then be attached to the facing sections 33 of the corrugated gypsum board 12 by studded or other means. FIG. 6 indicates the positions from which the top support 16, bottom support 18 and side supports 20 are attached to the corrugated gypsum board 12.

Once the corrugated gypsum board 12 has been fixed by channel supports 14 to form a panel core 11 a prefinished exterior skin panel 54 from a stack 55 is applied by adhesive or other means to both the corrugated gypsum board 12 and the channel supports 14 while the newly-formed panel core 11 is still on the forming and assembly table 50. Alternate exterior skin panels 54 may be used depending upon which part of a modular structure the panels 10 will form. Only one side of the panel 10 is covered, however, at this point. Each side of the corrugated board 12 provides preferably seven facing sections 33 for attachment to the exterior skin 54. When the modular fabrication panel unit 10 is incorporated as an exterior wall in a modular structure this exterior skin panel 54 will define the exterior side of the panel 10. This is the standard form of the panel unit 10 before it is incorporated into a modular structure.

Figure 11:
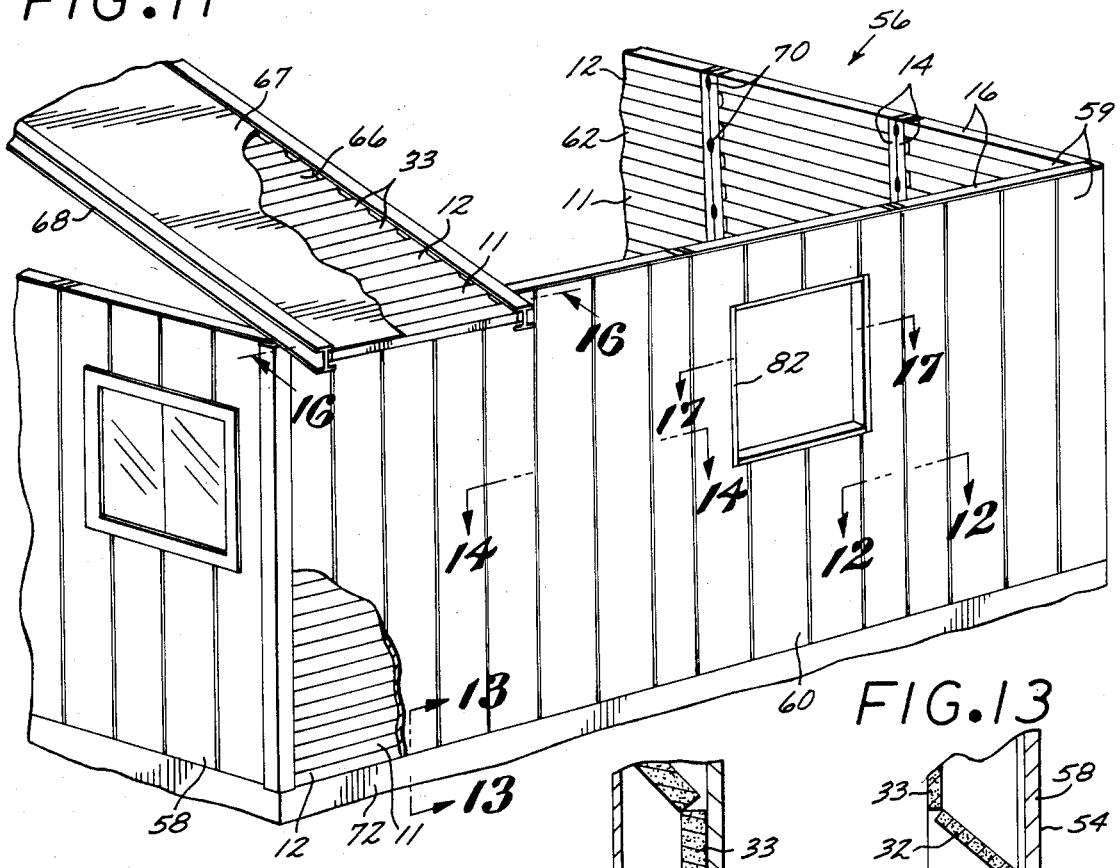
FIG. 11 is a fragmentary perspective view in elevation with portions broken away of a modular structure formed of an assembly of the modular panels of the present invention.
Figure 12:
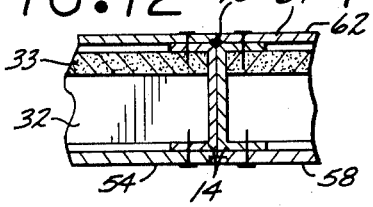
FIG. 12 is a fragmentary cross-sectional view taken on line 12—12 in FIG. 11.

FIGS. 11–17 indicate the manner in which panel units 10 are incorporated into a modular structure 56. A partially-assembled modular structure 56 is shown in FIG. 11. Notice that even though the modular structure 56 is not completed, the exterior skin panels 54 of the exterior wall panels 59 already form finished portions of the structure exterior 58. Two window panels 60 are shown as part of modular structure 56. These window panels 60 may be formed in either of the manners indicated for the construction of the modular door panel 24, as described above, utilizing a prefabricated window frame or an assembly of corrugated framing components. The interior 62 of the modular structure 56 is as yet unfinished, as indicated in FIG. 11, since interior facing skin 64 bearing prefinished vinyl covering 65 is not added to the panel units 10 until utility lines are run through the panel units 10 by means of the utility ports 22 in the channel supports 14. The gypsum board sections 32, by virtue of their horizontal disposition, readily accommodate and support such utility lines. Panel units 10 forming roof sections 66 bearing exterior roofing panels 67 are also shown in FIG. 11 braced by I-beam rafters 68. The exterior roofing panels 67 of these roof sections 66 do not require prefinishing as do the exterior skin panels 54. Although not shown in FIG. 11, panel units 10 may also form interior walls by covering both sides of a panel core 11 with interior facing 64. As indicated in FIGS. 11 and 12, when panel units 10 are contiguously incorporated side by side in a modular structure 56, the respective channel supports 14 of the panel units 10 are abutted and then fixed together by means of discrete channel welds 70. The abutted channel supports 14 together become structurally sound roofing supports in an I-beam configuration.

Figure 13:
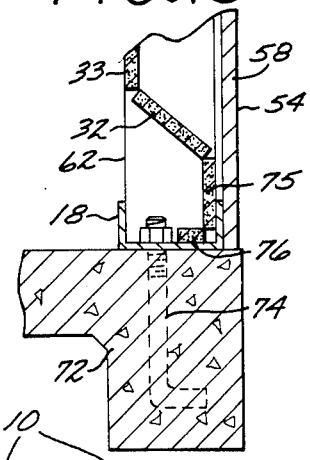
FIG. 13 is a fragmentary cross-sectional view taken on line 13—13 in FIG. 11.

FIG. 13 indicates the manner in which a panel unit 10 is anchored to a foundation 72. An anchor bolt 74 is set in a concrete foundation 72 with its threaded end extending upwardly through the bottom support 18 of the panel unit 10. Notice also that the bottom two horizontally-disposed sections 32 of the corrugated gypsum board 12 are set at right angles to each other within the bottom support 18 forming a foot section 76 and a wide upright support section 78. The wide upright support section 78 is wider than the rest of the facing sections 33 due to the cut of the wide double scoring rotary blades 49 located at the ends of the driving rods 46 of the rotary scoring saw 44, as previously described. A similar support configuration is consequently found proximate the top of the panel core 11 within the panel unit 10.

Figure 15:
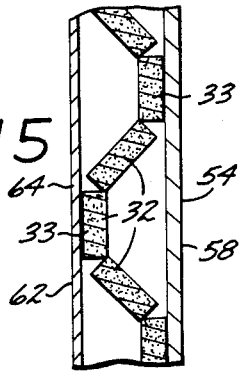
FIG. 15 is a fragmentary cross-sectional view taken on line 15—15 in FIG. 14.
Figure 14:
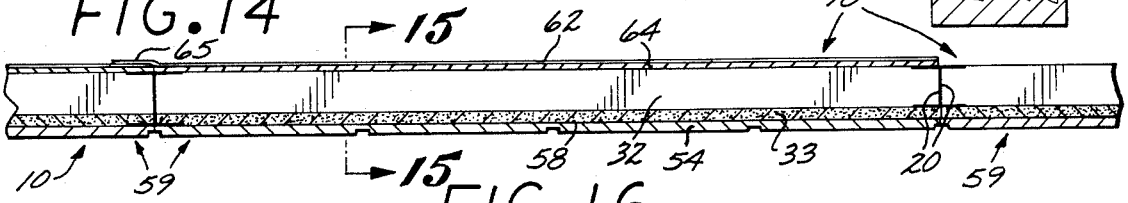
FIG. 14 is a fragmentary cross-sectional view taken on line 14—14 FIG. 11.

FIG. 14 shows the relationship of the exterior skin panels 54 and the interior facing panels 64 to the panel core 11 of the panel units 10. FIG. 15 indicates both the manner in which the corrugated gypsum board 12 is adhesively attached to the interior facing panels 64 and the exterior panels 54 and the passageways formed in the panel core 11 by the corrugated gypsum board 12 for the accommodation of utility lines.

Figure 16:
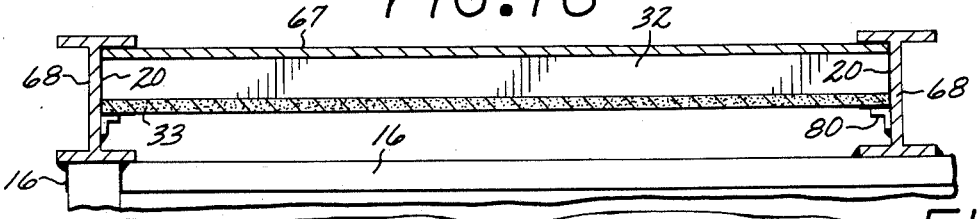
FIG. 16 is a fragmentary cross-sectional view taken on line 16—16 FIG. 11.

Panel units 10 forming roofing sections 66 are braced within I-beam rafters 68, as shown in FIG. 16, supported by roofing supports 80 which are in turn welded to the interior of the I-beam rafters 68. The panel core 11 and the exterior roofing panels 67 are then both braced between the roofing supports 80 and the horizontal sections of the I-beam rafters 68. The I-beam rafters 68 are in turn welded to the top of side supports 20 of panel units 10 comprising exterior wall panels 59, more than adequately supporting the modular panel units 10 which form the roof sections 66 of the modular structure 56.

Figure 17:
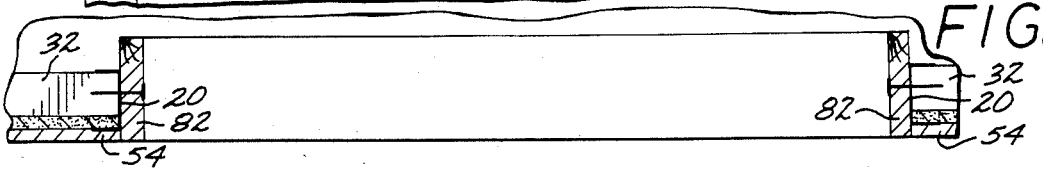
FIG. 17 is a fragmentary cross-sectional view taken on line 17—17 in FIG. 11.

FIG. 17 shows the way in which a window frame 82 may be attached to channel supports 14 in a window panel 60 by means of driving a nail through both the window frame 82 and the side supports 20 bracing the interior of the window panel 60. The modular door panel 24 described above may be framed in the same manner.

The modular fabrication panel system of the present invention thus provides a low cost load-bearing panel unit 10 which provides excellent fireproofing due to the horizontal disposition of the gypsum board sections 32 forming the corrugated gypsum board 12 since the horizontal disposition of these board sections 32 blocks the updraft within the panel unit 10 which typically causes a structural fire to spread. Additionally, the corrugated configuration of the panel core 11 traps air within the panel unit 10 and provides baffling for reflected sound such that the panel unit 10 has desirable acoustical and insulation properties. Skin panels 54 and 64 are securely attached to the core 11 owing to the extensive attachment area of the facing sections 33 provided by the truncated corrugation. The panel units 10 may be used for either exterior walls, interior walls or roofing sections. Once assembled into a modular structure 56, the contesserration of panel units variously designated for these functions forms a virtually prefinished structure.

While the present invention has been described with reference to presently preferred embodiments, it is to be understood that various modifications or alterations may be made by those skilled in the art without departing from the scope and spirit of the invention as set forth in the appended claims.

I claim:

1. A modular building panel unit which comprises:

a substantially rectangular gypsum board having first and second sheets of flexible material bonded to opposite flat sides of a gypsum core, said board having top and bottom edges and a pair of side edges;

a first series of pairs of scoring cuts in said board arranged substantially parallel to one of said pairs of edges, said scoring cuts passing through said first sheet and through at least the majority of the thickness of said gypsum core to proximate said second sheet;

a second series of pairs of scoring cuts in said board substantially parallel to said first series and passing through said second sheet and through at least the majority of the thickness of said gypsum core to proximate said first sheet;

each of said scoring cuts of said first and second series of pairs of scoring cuts having opposed, substantially parallel sides when said board is in a flat configuration before said board has been bent at said scoring cuts;

said first and second pairs of scoring cuts being alternately arrayed along said board; and said board being bent at said scoring cuts to a corrugated configuration in the form of a truncated series of alternating crests and troughs forming substantially planar outwardly facing sections on both sides of said panel unit, said bends in said board at said scoring cuts being enabled by each of said scoring cuts being opened outwardly with its said opposed sides angled outwardly relative to each other.

2. A modular building panel unit as defined in claim 1, wherein the corrugation of said board is substantially parallel to said top and bottom edges, and which comprises side support members extending along the lengths of both of said side edges of said board, said side support members supporting said board in its said corrugated configuration.

3. A modular building panel unit as defined in claim 2, wherein said side support members are substantially U-shaped channel members, said side edges of said board being engaged within said channel members.

4. A modular building panel unit as defined in claim 3, which comprises top and bottom support members extending along the lengths of said top and bottom edges of said board.

5. A modular building panel unit as defined in claim 4, wherein said top and bottom support members are substantially U-shaped channel members, said top and bottom edges of said board being engaged within said top and bottom support channel members.

6. A modular building panel unit as defiend in claim 5, wherein said outwardly-facing sections are substantially parallel.

7. A modular building panel unit as defined in claim 5, wherein a panel skin is attached to said planar outwardly-facing sections on at least one side of said panel unit.

8. A modular building panel unit as defined in claim 5 wherein panel skins are attached to said planar outwardly-facing sections on both sides of said panel unit.

9. A modular building panel unit as defined in claim 5, wherein said side support channel members have utility ports formed as necessary along their length in order to accommodate the passage of utility lines through said panel unit.

10. A modular building panel unit as defined in claim 3 wherein said outwardly-facing sections are substantially parallel.

11. A modular building panel unit as defined in claim 1, wherein a panel skin is attached to said planar outwardly-facing sections on at least one side of said panel unit.

12. A modular building panel unit as defined in claim 1 wherein panel skins are attached to said planar outwardly-facing sections on both sides of said panel unit.

13. A modular building panel unit as defined in claim 1, wherein the corrugation of said core is substantially parallel to said top and bottom edges.

14. A modular building panel unit as defined in claim 13, wherein said horizontal disposition of said corrugated core forms horizontal utility channels in order to facilitate the passage of utility lines through said panel unit.

* * * * *